United States Patent [19]

Knapp

[11] Patent Number: 4,531,678

[45] Date of Patent: Jul. 30, 1985

[54] INJECTION VALVE

[75] Inventor: Heinrich Knapp, Leonberg, Fed. Rep. of Germany

[73] Assignee: Robert Bosch GmbH, Stuttgart, Fed. Rep. of Germany

[21] Appl. No.: 486,775

[22] Filed: Apr. 20, 1983

[30] Foreign Application Priority Data

Aug. 18, 1982 [DE] Fed. Rep. of Germany ..... 3230671

[51] Int. Cl.[3] ..... F02M 61/00

[52] U.S. Cl. ..... 239/533.3; 239/585

[58] Field of Search ..... 239/585, 533.3–533.12; 251/139–141

[56] References Cited

U.S. PATENT DOCUMENTS 2,097,241 10/1937 Richards et al. ..... 239/533.3
4,311,280 1/1982 Knape ..... 239/585
4,365,747 12/1982 Knapp et al. ..... 239/585

FOREIGN PATENT DOCUMENTS 2033004 5/1980 United Kingdom ..... 239/585

*Primary Examiner*—Jeffrey V. Nase
*Assistant Examiner*—James R. Moon, Jr.
*Attorney, Agent, or Firm*—Edwin E. Greigg

[57] ABSTRACT

The invention is based on an injection valve which serves in particular to supply fuel to internal combustion engines having fuel injection systems. The injection valve includes a movable valve element, which cooperates with a fixed valve seat provided on a nozzle body.

Additionally, the movable valve element and the fixed valve seat each have complementary formed confronting surfaces, at least one of these surfaces being provided with a support such as a rib, thereby maintaining these surfaces in space relation. The rib may be provided on either the movable valve element or the fixed valve seat and can comprise an annular configuration whereby a collection chamber is provided between the respective surfaces. The confronting surfaces may be either concave or convex.

2 Claims, 2 Drawing Figures

INJECTION VALVE

BACKGROUND OF THE INVENTION

The invention is based on an injection valve as hereinafter defined in the ensuing specification. An injection valve has already been proposed in which the valve element is spherical and the valve seat is convex in embodiment. Swirl conduits which are inclined relative to the valve axis begin downstream of the valve seat; they discharge into a preparation bore embodied as a blind bore, at the open end of which the fuel is ejected so as to form a predetermined injection angle. In this embodiment, an injection angle larger than approximately 45° cannot be attained; however, for certain applications this angle is too small.

This application is a further improvement on devices of the type disclosed in the Knapp et al application Ser. No. 375,900, filed May 7, 1982, and now U.S. Pat. No. 4,416,238, which is assigned to the assignee of the present application.

OBJECT AND SUMMARY OF THE INVENTION

The injection valve according to the invention and having the characteristics of this invention has the advantage over the prior art that larger injection angles of up to approximately 60° can be attained.

By means of the characteristics disclosed in this application, advantageous further embodiments of and improvements to the injection valve disclosed herein can be attained.

The invention will be better understood and further objects and advantages thereof will become more apparent from the ensuing detailed description of two preferred embodiments taken in conjunction with the drawings.

DESCRIPTION OF THE PREFERRED EMBODIMENTS

Figure 1:
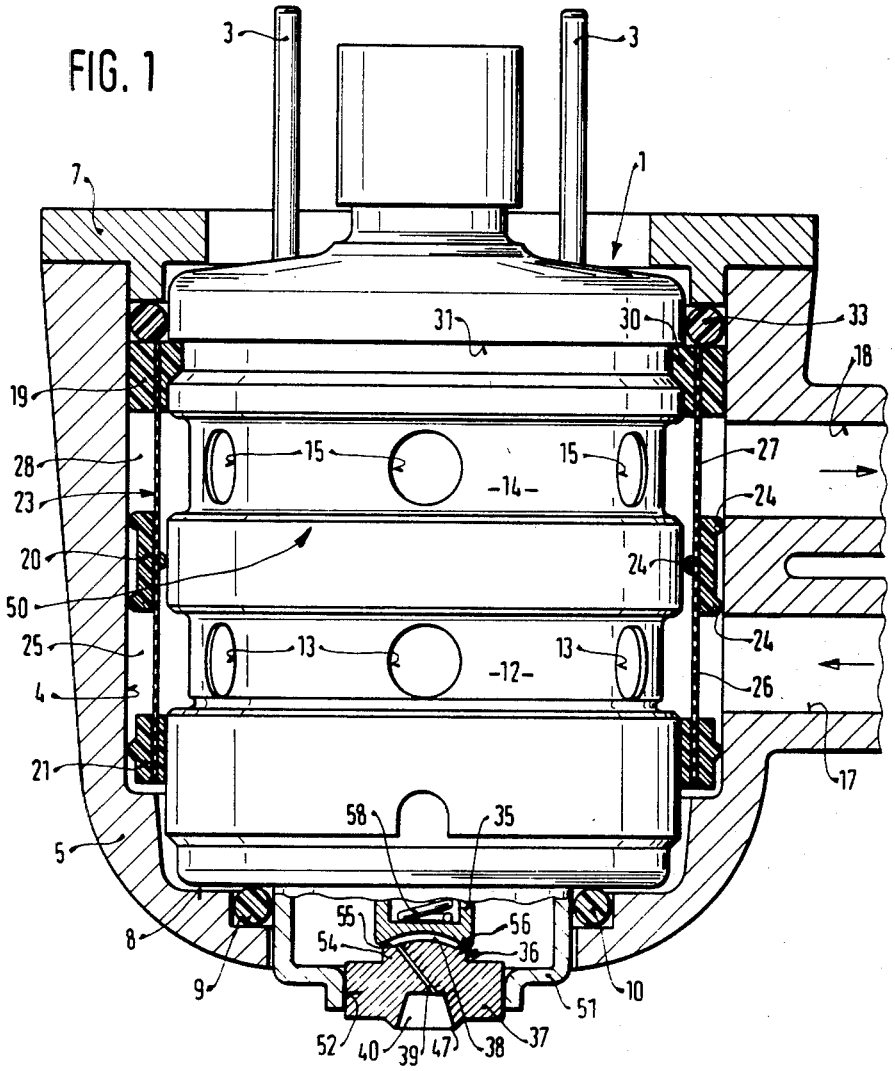
FIG. 1, in simplified form, shows a first exemplary embodiment in cross section of an injection valve according to the invention.

The fuel injection valve shown by way of example in FIG. 1 is actuatable electromagnetically in a known manner and serves, for example, as part of a fuel injection system for the injection of fuel, particularly at low pressure, into the air intake tube of mixture-compressing internal combustion engines with externally supplied ignition. The electrical triggering of the fuel injection valve 1 may be effected in a known manner via contact prongs 3. The fuel injection valve 1 is supported in a guide opening 4 of a holder body 5 and may be fixable in the axial direction, for instance, by a claw or a cap 7; a sealing ring 10 rests on one end face 8 of the fuel injection valve 1, remote from the cap 7, and at the other end is supported on a step 9 of the holder body 5. The holder body 5 may be embodied by the air intake tube wall itself, or it may be a separate part. The fuel injection valve 1 has an annular fuel delivery groove 12, from whence fuel delivery openings 13 lead into the interior of the fuel injection valve 1. The fuel injection valve 1 likewise has an annularly embodied fuel evacuation groove 14, which is axially offset from the fuel delivery groove 12 and is shown located above this groove 12 in the drawing. From the fuel evacuation groove 14, fuel evacuation openings 15 lead into the interior of the fuel injection valve 1. A fuel delivery line 17 discharges into the fuel delivery groove 12 and communicates in a manner not shown with a source of fuel supply, for instance a fuel pump. The fuel flowing via the fuel delivery line 17 into the fuel delivery groove 12 passes through the fuel delivery openings 13 into the interior of the fuel injection valve 1 and is either ejected into the air intake tube or, for the purpose of absorbing heat, flows through the fuel injection valve and emerges via the fuel evacuation openings 15 into the fuel evacuation groove 14, which communicates with a fuel evacuation line 18 embodied in the holder body 5. The fuel injection valve is guided in the radial direction in the guide opening 4 of the holder body 5 by means of elastic support bodies 19, 20, 21 of a fuel filter 23, which extends in the axial direction overlapping the fuel delivery groove 12 and the fuel evacuation groove 14. The support bodies 19, 20, 21 are fabricated of some elastic material, such as rubber or plastic. The middle support body 20 in particular is embodied annularly in such a way that, being provided by way of example with sealing protrusions 24, it is supported on the circumference of the fuel injection valve 1 between the fuel delivery groove 12 and the fuel evacuation groove 14 on the one hand and on the guide opening 4 on the other, such that it seals off the fuel delivery groove 12 and the fuel delivery line 17 from the fuel evacuation groove 14 and the fuel evacuation line 18. The fuel which flows through the fuel delivery line 17 first reaches an annular groove 25 embodied between the middle support body 20 and the lower end support body 21 of the fuel filter, and can then flow out of this annular groove 25 through the filtering zone 26 into the fuel delivery groove 12. From the fuel evacuation groove 14, the fuel can flow via the filtering zone 27 into an annular groove 28 embodied between the upper end support body 19 and the middle support body 20 of the fuel filter 23; this annular groove 28 being arranged to communicate with the fuel evacuation line 18. By means of the filtering zones 26, 27, dirt particles contained in the fuel are filtered out. In particular as a result of the elastic embodiment of the middle support body 20, simpler machining and wider tolerances are possible at the circumference of the fuel injection valve 1 and in terms of the diameter of the guide opening 4. The upper support body 19 can be provided on its side oriented toward the fuel injection valve 1 with a locking protrusion 30, which locks into a locking groove 31 of the fuel injection valve when the fuel filter 23 is pushed onto the fuel injection valve, the result being that the fuel injection valve 1 can then be inserted in common with the mounted fuel filter 23 into the guide opening 4 of the holder body 5. A sealing ring 33 can also be supported axially on the upper support body 19, this sealing ring 33 being disposed between the fuel injection valve 1 and the holder body 5 and being positionally fixed at the other end by means of the cap 7.

The fuel injection valve 1 has a movable valve element 35, which cooperates with a fixed valve seat 36 in a nozzle body 37. The movable valve element 35 is raised from the valve seat when the electromagnet of the fuel injection valve 1 is excited, so that fuel can then flow between the movable valve element 35 and the valve seat 36 and thus reach a collection chamber 38 having the least possible volume. Swirl conduits 39, only one of which is shown in the drawing, lead from the collection chamber 38 to a preparation bore 40 in the nozzle body 37. The swirl conduits 39 extend in the axial direction at an inclination with respect to the injection valve axis and discharge into the preparation bore 40, over the wall of which the fuel spreads in the form of a film and flows toward the open end 47 of the nozzle body 37, which is embodied as a sharp edge or lip. The fuel film breaks off of the annular lip 47 and then emerges into the flow of aspirated air, whereupon a uniform mixing of air and fuel takes place. This is to be understood to be a necessary condition for both low fuel consumption and exhaust emissions low in toxic substances. The swirl conduits 39 simultaneously serve as metering conduits. If the fuel pressure upstream of the valve seat 36 remains constant, a linear valve characteristic is accordingly attained; that is, a linear ratio exists between the duration of the opening period of the valve and the quantity of injected fuel.

A nozzle carrier 51 is connected with the valve housing 50, by means of a flange, for instance, and has a receiving bore 52 into which the nozzle body 37 is inserted and secured, for instance by soldering or welding.

A protrusion 54 is embodied on the nozzle body 37 oriented toward the valve element 35, and the valve seat 36 is embodied in convex form on this protrusion 54 in accordance with the invention. It may be advantageous for a raised step 55 to be provided on the protrusion 54, the step 55 being embodied as the valve seat 36 in annular form. In an appropriately adapted manner, the valve element 35 has a concave sealing surface 56 oriented toward the convex valve seat 36. When the sealing surface 56 is resting on the annular rib or step 55, the collection chamber 38 is formed between the valve element 35 and the protrusion 54 of the nozzle body 37. The valve element 35 is urged in the closing direction of the valve by a spring 58, which engages the valve element 35. In order to attain the flattest possible injection angle of the fuel emerging at the open end 47, the swirl conduits 39 should begin at the collection chamber 38 as close as possible to the annular rib or step 55. The critical factor for the injection angle of the fuel is again an optimized diameter of the preparation bore 40 at the mouth of the swirl conduits and an optimized inclination of the wall of the preparation bore 40 toward the open end 47, in the direction of an enlargment of the cross section of the preparation bore 40.

Figure 2:
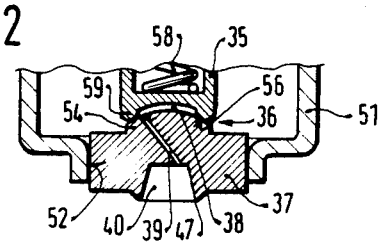
FIG. 2 is a partial cross-sectional view of a second exemplary embodiment of an injection valve according to the invention.

In the fuel injection valve shown in part in FIG. 2, the elements having the same function as those of the exemplary embodiment of FIG. 1 are identified by the same reference numerals. The exemplary embodiment of FIG. 2 differs from that of FIG. 1 solely in that a continuously convex valve seat surface 36 is embodied on the protrusion 54, oriented toward the valve element 35, while a dependent annular rib or step 59 which forms a concave annular sealing surface 56 is embodied on the valve element 35. A recess is provided in the valve element 35, offset from the annular rib or step 59, in the closed state of the valve, this recess thus forms the collection chamber 38.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. An injection valve, in particular for fuel injection systems of internal combustion engines, having a movable valve element having a concave surface arranged to cooperate with a fixed valve seat having a complementary confronting convex surface, said surfaces having the same radius of curvature over substantially their entire confronting extent, said valve further having an axis and being provided in a nozzle body, said convex surface of said fixed valve seat being provided with an annular rib for supporting said complementary surfaces in spaced relation for defining a collecting chamber therebetween, said valve seat being provided with swirl conduits inclined relative to said valve axis, said swirl conduits being provided with a mouth opening into said collecting chamber disposed immediately adjacent said annular rib, said swirl conduits being arranged to exit fuel from said conduits into a preparation bore, and said annular rib has a short height so as to define a de minimis volume within said collecting chamber.

2. An injection valve, in particular for fuel injection systems of internal combustion engines, having a movable valve element having a concave surface arranged to cooperate with a fixed valve seat having a complementary confronting convex surface, said surfaces having the same radius of curvature over substantially their entire confronting extent, said valve further having an axis and being provided in a nozzle body, said concave surface of said movable valve element being provided with an annular rib for supporting said complementary surfaces in spaced relation for defining a collecting chamber therebetween, said valve seat being provided with swirl conduits inclined relative to said valve axis, said swirl conduits being provided with a mouth opening into said collecting chamber disposed immediately adjacent said annular rib, said swirl conduits being arranged to exit fuel from said conduits into a preparation bore.

* * * * *